US011920418B2

(12) United States Patent
Burky et al.

(10) Patent No.: US 11,920,418 B2
(45) Date of Patent: Mar. 5, 2024

(54) APPARATUS AND METHOD FOR BEHIND CASING WASHOUT

(71) Applicant: Halliburton Energy Services, Inc., Houston, TX (US)

(72) Inventors: Thomas Earl Burky, Mansfield, TX (US); Christopher C. Hoelscher, Arlington, TX (US); James Marshall Barker, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 270 days.

(21) Appl. No.: 17/603,069

(22) PCT Filed: Apr. 24, 2019

(86) PCT No.: PCT/US2019/028830

§ 371 (c)(1),
(2) Date: Oct. 12, 2021

(87) PCT Pub. No.: WO2020/219034

PCT Pub. Date: Oct. 29, 2020

(65) Prior Publication Data

US 2022/0178218 A1 Jun. 9, 2022

(51) Int. Cl.
*E21B 29/02* (2006.01)
*E21B 33/134* (2006.01)
*E21B 43/117* (2006.01)

(52) U.S. Cl.
CPC ..... *E21B 29/02* (2013.01); *E21B 33/134* (2013.01); *E21B 43/117* (2013.01)

(58) Field of Classification Search
CPC ..... E21B 29/02; E21B 33/134; E21B 43/117
USPC ..... 102/310
See application file for complete search history.

(56) References Cited

U.S. PATENT DOCUMENTS

| | | | | |
|---|---|---|---|---|
| 4,423,781 | A | 1/1984 | Thomas | |
| 5,785,130 | A * | 7/1998 | Wesson | E21B 43/1185 175/4.6 |
| 8,973,662 | B2 | 3/2015 | Xu et al. | |
| 9,010,425 | B2 | 4/2015 | Larsen et al. | |
| 2005/0173118 | A1* | 8/2005 | Li | E21B 43/117 175/4.6 |

(Continued)

FOREIGN PATENT DOCUMENTS

| | | |
|---|---|---|
| WO | 2015105427 A2 | 7/2015 |
| WO | 2016022146 A1 | 2/2016 |

*Primary Examiner* — Samir Abdosh
(74) *Attorney, Agent, or Firm* — John Wustenberg; Parker Justiss, P.C.

(57) ABSTRACT

Provided is a casing washout perforating gun assembly for use in a wellbore. The casing washout perforating gun assembly, in one example, includes a carrier gun body, an uphole plurality of charges supported within the carrier gun body, and a downhole plurality of charges supported within the carrier gun body. According to this example, the uphole plurality of charges have an uphole size or uphole explosive design to perforate uphole openings having uphole opening areas within a wellbore casing, and the downhole plurality of charges have a different downhole size or different downhole explosive design to perforate downhole openings having downhole opening areas within the wellbore casing, and furthermore the downhole opening areas are at least 20 percent less than the uphole opening areas.

19 Claims, 9 Drawing Sheets

(56) References Cited

U.S. PATENT DOCUMENTS

| | | | | |
|---|---|---|---|---|
| 2009/0242198 | A1 | 10/2009 | Evans et al. | |
| 2013/0312963 | A1* | 11/2013 | Larsen | E21B 43/116 166/376 |
| 2014/0138078 | A1* | 5/2014 | Lerbrekk | E21B 29/02 166/55 |
| 2015/0021025 | A1* | 1/2015 | Myhre | E21B 21/00 166/113 |
| 2015/0053405 | A1* | 2/2015 | Bakken | E21B 37/08 166/285 |
| 2016/0130495 | A1 | 5/2016 | Doan et al. | |
| 2017/0167233 | A1* | 6/2017 | Sampson | E21B 43/117 |
| 2017/0191354 | A1* | 7/2017 | Acker | E21B 43/11 |
| 2017/0275975 | A1* | 9/2017 | Hardesty | E21B 43/119 |
| 2018/0298715 | A1 | 10/2018 | Shafer | |
| 2019/0063197 | A1* | 2/2019 | Walters | E21B 43/117 |
| 2020/0300072 | A1* | 9/2020 | Snider | E21B 43/26 |
| 2022/0178218 | A1* | 6/2022 | Burky | E21B 43/117 |
| 2023/0160277 | A1* | 5/2023 | Rege | E21B 33/134 166/192 |
| 2023/0184066 | A1* | 6/2023 | Hoelscher | E21B 43/119 175/297 |
| 2023/0349253 | A1* | 11/2023 | Zakharia | E21B 23/065 |

* cited by examiner

APPARATUS AND METHOD FOR BEHIND CASING WASHOUT

CROSS-REFERENCE TO RELATED APPLICATION

This application is the National Stage of, and therefore claims the benefit of, International Application No. PCT/US2019/028830 filed on Apr. 24, 2019, entitled "APPARATUS AND METHOD FOR BEHIND CASING WASHOUT," which was published in English under International Publication Number WO 2020/219034 on Oct. 29, 2020. The above application is commonly assigned with this National Stage application and is incorporated herein by reference in its entirety.

BACKGROUND

Statutory regulations require pressure isolation, among other things, across reservoir zones in a subterranean well during plug and abandonment of the well. In this context, casings through such permeable zones may be required to be pressure-isolated at both the outside and the inside of the particular casing in the well.

Traditionally, such plugging and abandonment is carried out by means of so-called milling technology. In this context, a mechanical milling tool is routed to a desired location in the particular casing in the well. Then, a longitudinal section of the casing is milled into pieces, after which ground up metal shavings, cement pieces, and/or heaving drilling mud or brine (e.g., that has set for a long time) are circulated out of the well. Subsequently, a so-called underreamer is routed into the casing to drill a larger wellbore along said longitudinal section, and in such a way that the wellbore is enlarged diametrically by drilling into new formation along the longitudinal section. Next, a plugging material, typically cement slurry, is pumped down through the tubular string and out into the enlarged wellbore, and possibly into proximate casing portions above and below the enlarged wellbore, thereby forming the plug.

Nevertheless, plug and abandonment processes have improved in recent years, whereby the longitudinal section of the casing is perforated using a standard perforation tool, and thereafter the cement and/or heaving drilling mud or brine on the back side of the longitudinal section of the casing are removed using a washout process. With the cement, drilling mud and/or brine removed in the longitudinal section of the casing, new cement may be injected through the openings within the casing created by the perforation process, and the well can then be appropriately plugged from both sides of the casing.

The typical perforating approach for plug an abandonment operations attempts to maximize the perforation hole size for the largest flow area-both in removing the excess debris (e.g., casing, cement particles, heavy drilling mud, brine, etc.), as well as pumping in the new cement slurry. Unfortunately, the larger perforation hole sizes may be very difficult to obtain, cause excessive damage to the casing, and may actually provide non-optimal washing conditions. Thus, what is needed in the art is an optimized perforation/washing technology that does not experience the drawbacks of the existing perforation/washing technologies.

BRIEF DESCRIPTION

Reference is now made to the following descriptions taken in conjunction with the accompanying drawings, in which.

Figure 2A:
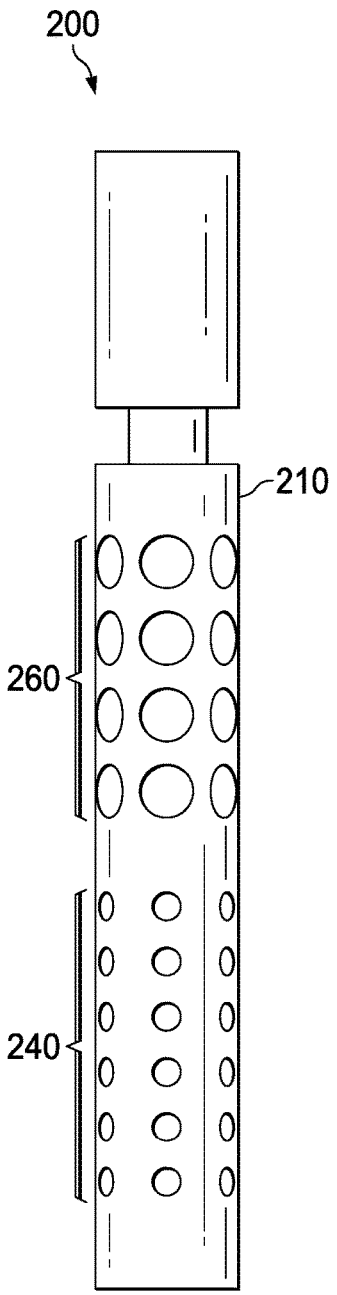
FIGS. 2A-2C illustrate different embodiments of a casing washout perforating gun assembly designed and manufactured according to the disclosure.
Figure 3A:
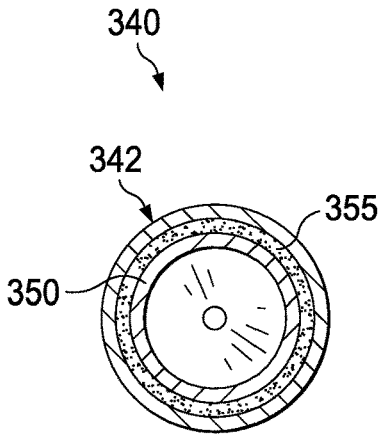
Figure 3B:
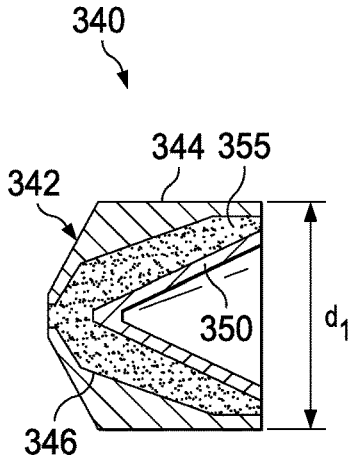
Figure 4A:
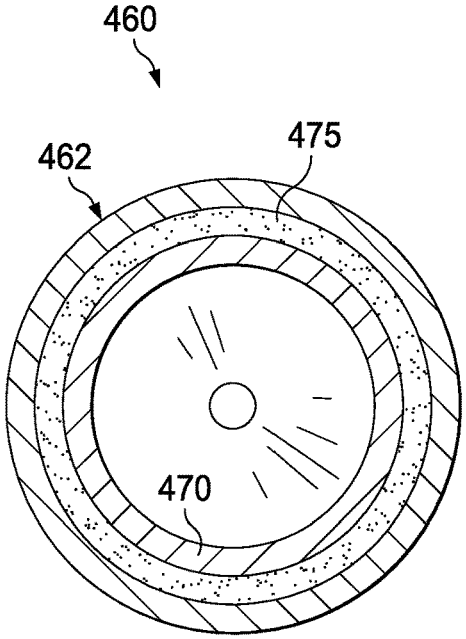
Figure 4B:
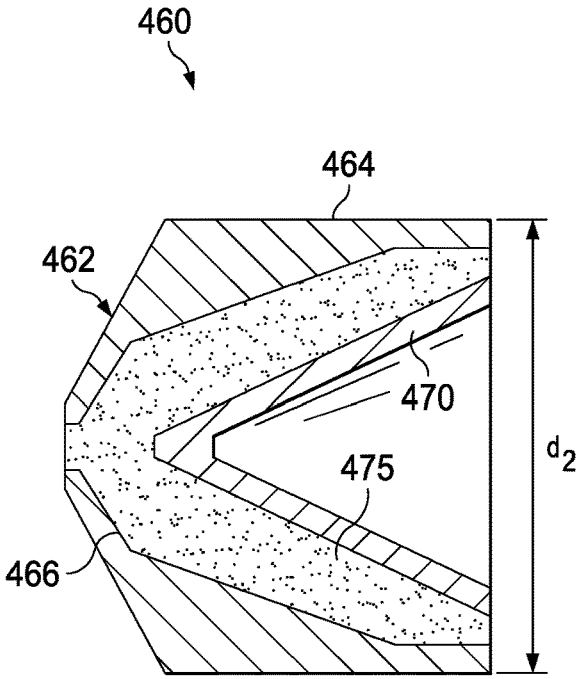

FIGS. 3A and 3B, as well as FIGS. 4A and 4B, illustrate different views of a downhole charge and an uphole charge, respectively, as might be used in the carrier gun body of FIG. 2A; and FIGS. 5-9 illustrate a method for washing and plugging a wellbore in accordance with the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Figure 1:
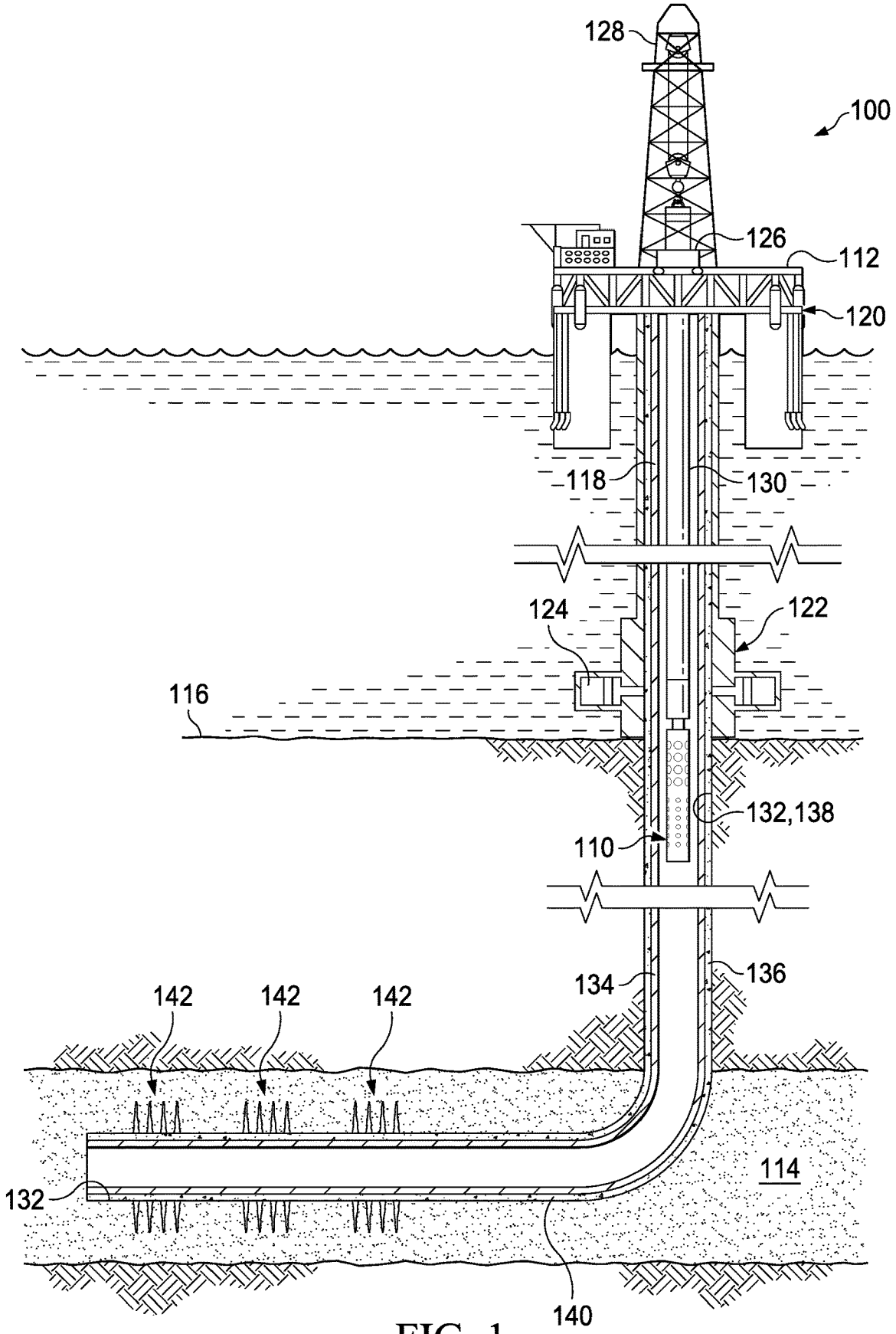
FIG. 1 is a schematic illustration of a well system including a plurality of perforating gun assemblies of the present disclosure operating in a subterranean formation.

Referring initially to FIG. 1, schematically illustrated is a well system 100 including a casing washout perforating gun assembly 110 of the present disclosure operating in a subterranean formation (e.g., from an offshore oil and gas platform). A semi-submersible platform 112 is positioned over a submerged oil and gas formation 114 located below sea floor 116. A subsea conduit 118 extends from a deck 120 of the platform 112 to a wellhead installation 122, which may include one or more subsea blow-out preventers 124. In the illustrated embodiment, the platform 112 has a hoisting apparatus 126 and a derrick 128 for raising and lowering pipe strings, such as work string 130. As used herein, work string encompasses any conveyance for downhole use, including drill strings, completion strings, evaluation strings, other tubular members, wireline systems, and the like.

A wellbore 132 extends through the various earth strata including formation 114. In the embodiment of FIG. 1, a casing 134 is cemented within wellbore 132 by cement 136. In the illustrated embodiment, the work string 130 is deployed within the wellbore 132. The work string 130 may include various tools, including the casing washout perforating gun assembly 110 of the present disclosure. When it is desired to plug and abandon the wellbore 132, work string 130 is lowered through casing 134 until the casing washout perforating gun assembly 110 is properly positioned relative to a desired longitudinal location in the wellbore 132. In the illustrated embodiment, the casing washout perforating gun assembly 110 is positioned in a vertical portion 138 near an opening of the wellbore 132. In other embodiments, however, the casing washout perforating gun assembly 110 may be properly positioned in a horizontal portion 140 of the wellbore 132, for example above each of the production zones 142. In yet other embodiments, the casing washout perforating gun assembly 110 may be positioned (e.g., in a single setting or over time) at various different combinations of locations within the wellbore 132.

In the illustrated embodiment, wellbore 132 has an initial, generally vertical portion 138 and a lower horizontal portion 140 (e.g., generally deviated portion). It should be noted, however, by those skilled in the art that the casing washout perforating gun assembly 110 of the present disclosure is equally well-suited for use in other well configurations including, but not limited to, inclined wells, wells with restrictions, non-deviated wells and the like. Moreover, while the wellbore 132 is positioned below the sea floor 116 in the illustrated embodiment of FIG. 1, those skilled in the art understand that the principles of the present disclosure are equally as applicable in other subterranean formations, including those encompassing both areas below exposed earth and areas below earth covered by water such as ocean or fresh water.

A casing washout perforating gun assembly according to the present disclosure may tailor the relative sizes of the charges, and thus openings in the wellbore casing, to optimize the washing process. For example, the present disclosure has recognized that smaller openings in the lower part of each washing segment may be used to increase the flow velocity and turbulence of the wash fluid as it enters the annulus. These smaller openings could be angled relative to one another to increase localized turbulent flow. The present disclosure has further recognized that larger openings in the upper part of each washing segment may be used to allow larger solids to pass through from the annulus back inside the casing above the washing segment. The present disclosure has recognized that by increasing fluid viscosity and density, the solids can be more effectively suspended. The present disclosure has further recognized that abrasive materials may additionally be incorporated into the fluid to increase both density and the ability to breakdown large chunks of material in the annulus. Additionally, engineered flow restrictions in the flow path back to the surface may be used to keep fluid velocity high, to optimize the suspension of solids on trip to surface. Moreover, the present disclosure has recognized that the shot pattern of both the small and large openings may be optimized by using different axial spacing and/or phase angles.

The present disclosure has further recognized that the displacement of material in the annulus is complex and driven by many factors, including: time of contact (how long the washing apparatus stays in one location), flow rate and frictional forces, density, mechanical agitation, and mechanical abrasion. The present disclosure has recognized that increased fluid viscosity and density will suspend the solids. For example, the density can be modified using by adding bromine salts or similar additives. The fluid viscosity can be optimized by using additives, such as polymers or gelling agents. The flow rate may be increased with increasing pump capacity, while frictional (or drag) force is directly proportional to viscosity. The present disclosure has recognized that if the material to be removed from the annulus is rubbished cement, then mechanical agitation could be enhanced by the action of the fluid flow causing the rubble to shift back and forth and impact on the casing and other rubble, further breaking it down until it is small enough to fit through the large holes and be lifted to the surface. The present disclosure has further recognized that mechanical abrasion can also assist with this last process by using incorporated abrasive materials (e.g. sand) in the fluid flow.

Turning to FIG. 2A, illustrated is one embodiment of a casing washout perforating gun assembly 200 designed and manufactured according to the disclosure. The casing washout perforating gun assembly 200, in the illustrated embodiment, includes a carrier gun body 210. Supported within the carrier gun body 210 in the embodiment of FIG. 2A, are a downhole plurality of charges 240, and an uphole plurality of charges 260. The downhole plurality of charges 240 and uphole plurality of charges 260, in the illustrated embodiment, are shaped charges. Nevertheless, other types of charges are within the scope of the present disclosure. In accordance with the disclosure, the downhole plurality of charges 240 are configured to perforate smaller openings within a wellbore casing than the uphole plurality of charges 260.

Turning briefly to FIGS. 3A and 3B, as well as FIGS. 4A and 4B, illustrated are different views of a downhole charge 340 and an uphole charge 460, respectively, as might be used in the carrier gun body 210 of FIG. 2A. The downhole charge 340, in the illustrated embodiment, includes a case exterior 342 having a diameter ($d_1$). The case exterior 342, in the illustrated embodiment includes an outer surface 344 and an inner surface 346 forming a cavity. The downhole charge 340 additionally includes a liner 350 located within the cavity, as well as explosive material 355 located within a gap between the inner surface 346 of the case exterior 342 and the liner 350.

The uphole charge 460 is similar in many respects to the downhole charge 340. For example, the uphole charge 460, in the illustrated embodiment, includes a case exterior 462 having a diameter ($d_2$). The case exterior 462, in the illustrated embodiment includes an outer surface 464 and an inner surface 466 forming a cavity. The uphole charge 460 additionally includes a liner 470 located within the cavity, as well as explosive material 475 located within a gap between the inner surface 466 of the case exterior 462 and the liner 470.

In accordance with one embodiment of the disclosure, the diameter ($d_1$) of the case exterior 342 for the downhole charge 340 is at least 20 percent smaller than the diameter ($d_2$) of the case exterior 462 for the uphole charge 460. In fact, in one particular embodiment, the diameter ($d_1$) of the case exterior 342 is at least 50 percent smaller than the diameter ($d_2$) of the case exterior 362. In another particular embodiment, the diameter ($d_1$) of the case exterior 342 is at least 60 percent smaller than the diameter ($d_2$) of the case exterior 362, and in yet another embodiment the diameter ($d_1$) of the case exterior 342 is at least 66 percent smaller than the diameter ($d_2$) of the case exterior 362. Accordingly, any openings within the wellbore casing that may result from a detonation of the downhole charge 340 would ideally have a diameter ($d_s$) less than diameter ($d_1$) of openings within the wellbore casing that may result from a detonation of the uphole charge 460. While a specific type of charge has been illustrated in FIGS. 3A, 3B, 4A and 4B, those skilled in the art understand that the present disclosure is not limited to this type of charge, and thus other types of charges (e.g., shaped charges or not) are within the purview of the disclosure.

It should be noted, however, that the smaller downhole openings and larger uphole openings may, in certain embodiments, be formed even though the diameter ($d_1$) of the case exterior 342 and the diameter ($d_2$) of the case exterior 462 are substantially similar. For example, even though the diameter ($d_1$) and the diameter ($d_2$) are substantially similar, the explosive design (e.g., interior components) of the downhole charge 340 and the uphole charge 460 could be modified to form the smaller downhole openings and the larger uphole openings. In one example embodiment, the liner 350 could be a conical liner configured to form a smaller opening, whereas the liner 470 could be a parabolic liner configured to form a larger opening. In another example embodiment, the type of explosive material used for the downhole charge 340 and uphole charge 460 may differ from one another to form the different size openings. Other configurations are within the scope of the disclosure.

Returning back to FIG. 2A, the downhole plurality of charges 240 and the uphole plurality of charges 260 are linearly aligned with the carrier gun body 210. The term linearly aligned, as used in this context, means that the downhole plurality of charges 240 are aligned in columns that are substantially parallel with a longitudinal axis of the carrier gun body 210 and rows that are substantially perpendicular with the longitudinal axis of the carrier gun body 210, and that the uphole plurality of charges 260 are aligned in columns that are substantially parallel with the longitudinal axis of the carrier gun body 210 and rows that are substantially perpendicular with the longitudinal axis of the carrier gun body 210. Given the possibility of difference in diameters for the downhole plurality of charges 240 and the uphole plurality of charges 260, their respective columns may not linearly align with one another.

Figure 2B:
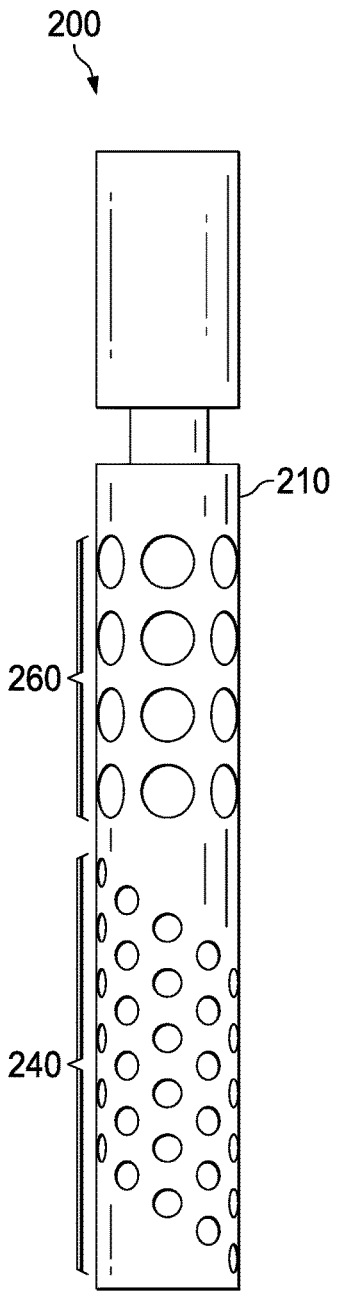

Turning briefly to FIG. 2B, illustrated is another embodiment of the casing washout perforating gun assembly 200, wherein the downhole plurality of charges 240 are helically aligned with the carrier gun body 210. In the illustrated embodiment of FIG. 2B, the downhole plurality of charges 240 are left-hand helically aligned with the carrier gun body 210, whereas the uphole plurality of charges 260 are linearly aligned with the carrier gun body 210. In one embodiment, the helically aligned downhole charges 240 create helically aligned openings in the wellbore casing when detonated, which will optimally lead to uphole swirling of the washout fluid during a subsequent washout process.

Figure 2C:
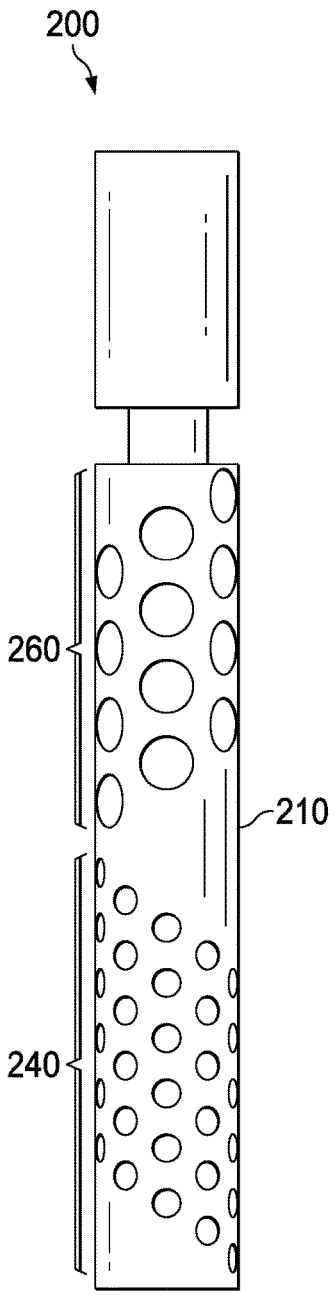

Turning briefly now to FIG. 2C, illustrated is another embodiment of the casing washout perforating gun assembly 200, wherein both the downhole plurality of charges 240 and uphole plurality of charges 260 are helically aligned with the carrier gun body 210. In the illustrated embodiment of FIG. 2B, the downhole plurality of charges 240 are left-hand helically aligned with the carrier gun body 210, whereas the uphole plurality of charges 260 are right-hand helically aligned with the carrier gun body 210. Nevertheless, the opposite handedness may also be used.

Figure 5:
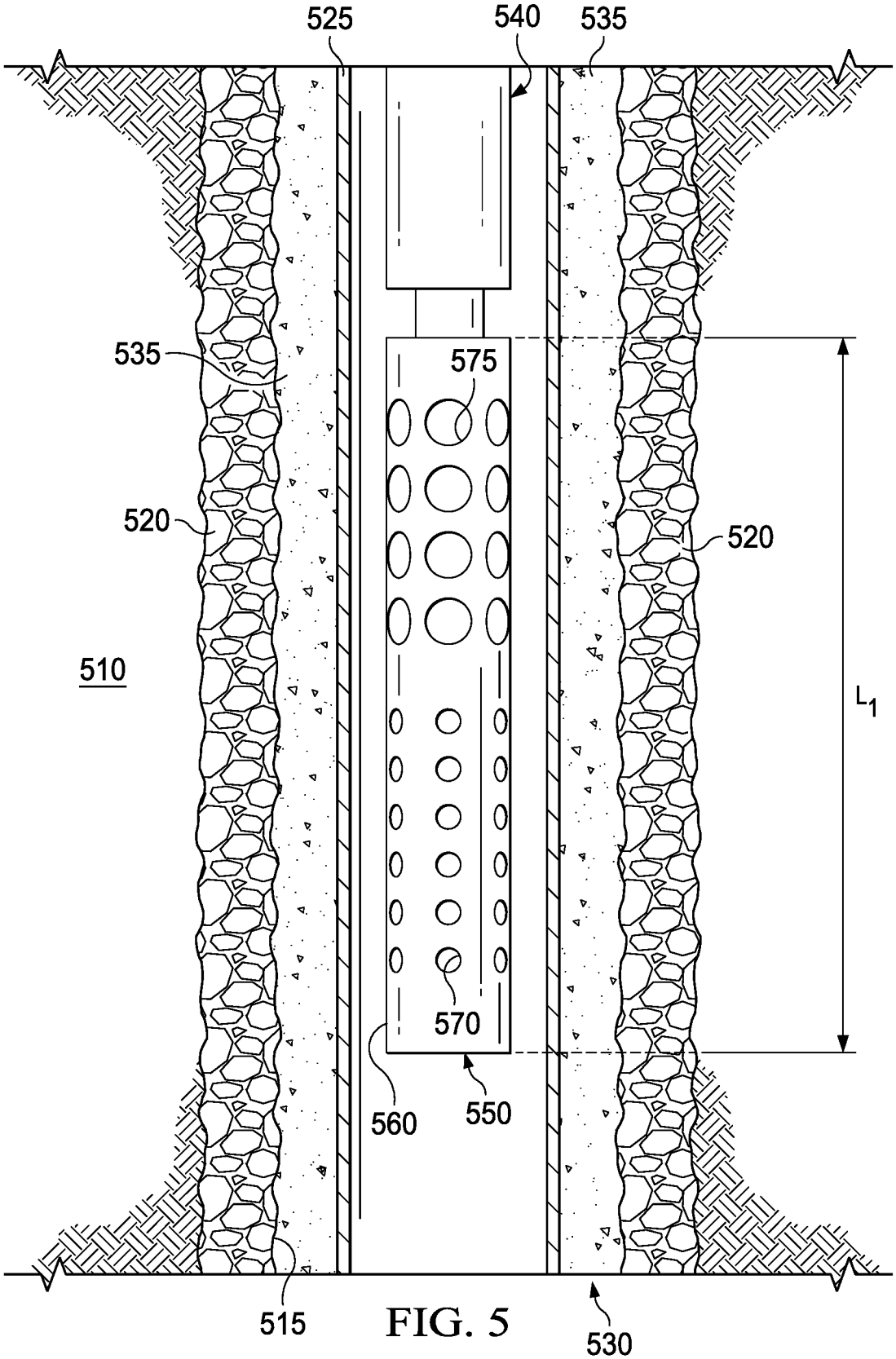

Turning now to FIGS. 5-9, illustrated is a method for washing and plugging a wellbore. FIG. 5 illustrates a portion of a typical petroleum well 510 to be plugged in accordance with the disclosure. The well 510 has been formed, in a known manner, by drilling a wellbore 515 through a subterranean formation 520, after which a wellbore casing 525 has been employed within the wellbore 515. The wellbore casing 525, in the illustrated example, has been fixed in the wellbore 515 by circulating cement slurry into an annulus 530 located between the subterranean formation 520 and the wellbore casing 525. Thereafter, the cement slurry has been allowed to cure into cement 535. In some cases, drilling fluid or another suitable well fluid is circulated into the annulus 530 instead. Subsequently, the well portion may be completed with drilling fluid or another well fluid present in the annulus 530.

FIG. 5 additionally illustrates a work string 540 having a lower end connected to a casing washout perforating gun assembly 550 manufactured and designed according to the disclosure. The work string 540 and the casing washout perforating gun assembly 550 are positioned at a desired location within a longitudinal section of the wellbore casing 525. The casing washout perforating gun assembly 550, in the illustrated embodiment, includes a carrier gun body 560 having a length $L_1$. In accordance with the disclosure, the casing washout perforating gun assembly 550 includes a downhole plurality of charges 570 and an uphole plurality of charges 575, wherein the downhole plurality of charges 570 are configured to perforate a smaller opening within the wellbore casing 525 than the uphole plurality of charges 575. For example, the plurality of smaller downhole openings might ideally have downhole opening areas at least 20 percent less than uphole opening areas of the plurality of larger uphole openings.

The work string 540 may be formed from drill pipes or coiled tubing, among others. FIG. 5 shows the work string 540 and the casing washout perforating gun assembly 550 disposed in the wellbore casing 525 at a particular perforation location in the well 510, immediately before detonation of the downhole plurality of charges 570 and the uphole plurality of charges 575. As an alternative to using the work string 540, wireline operation may possibly be used to deploy the casing washout perforating gun assembly 550 into the wellbore casing 525.

Figure 6A:
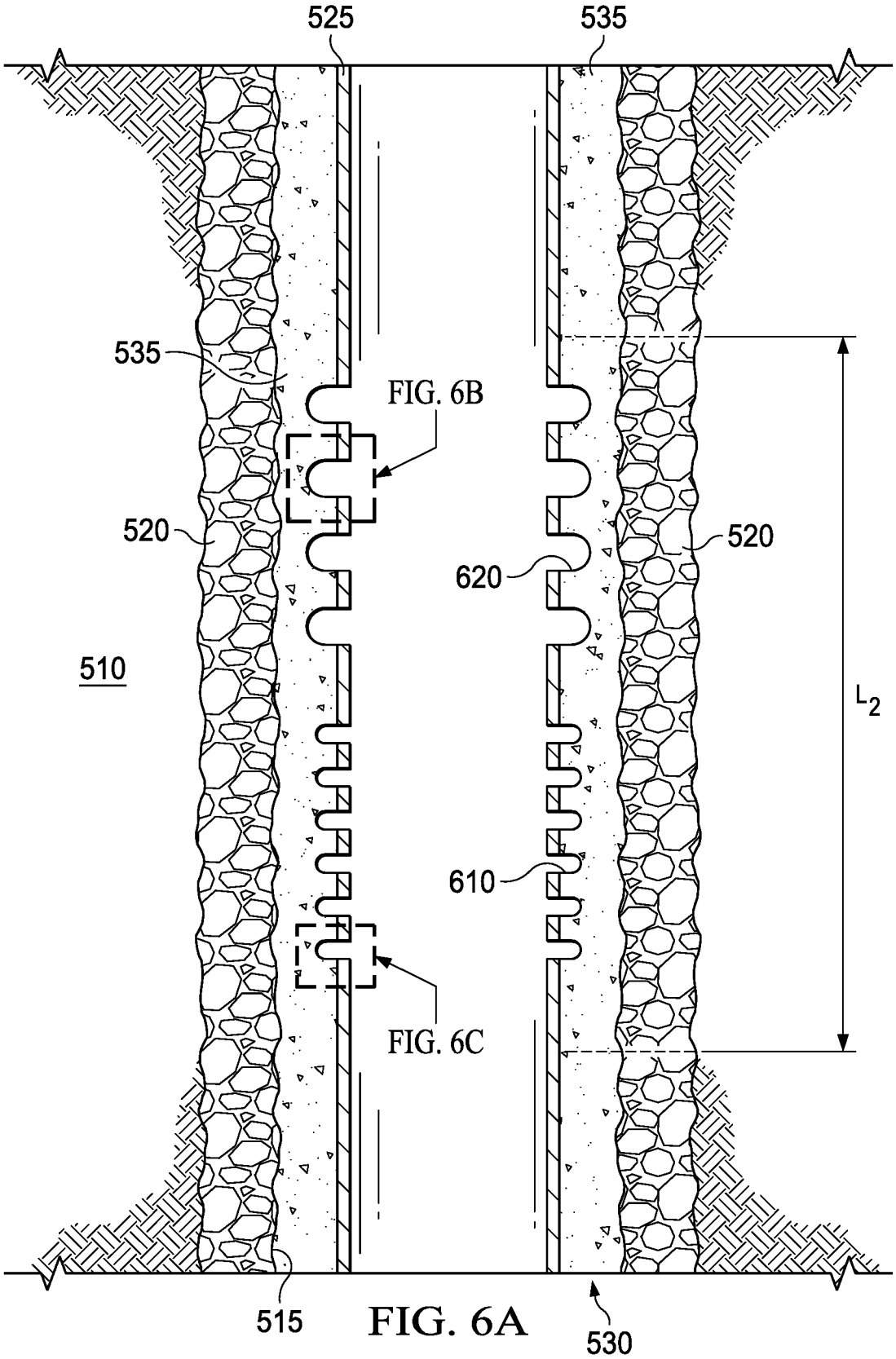

Turning to FIG. 6A, illustrated is the well 510 after detonation of the downhole plurality of charges 570 and the uphole plurality of charges 575, and after having pulled the work string 540 and the casing washout perforating gun assembly 550 out of the well 510. As a result of the detonation, a plurality of smaller downhole openings 610 and a plurality of larger uphole openings 620 have been formed through the tubular wall of the wellbore casing 525, and along a longitudinal section $L_2$ of the well 510. In the illustrated embodiment, downhole opening areas of the plurality of smaller downhole openings 610 are at least 20 percent smaller than uphole opening areas of the plurality of larger uphole openings 620. In one particular embodiment, a diameter ($d_s$) of the plurality of smaller downhole openings 610 is at least 20 percent smaller than the diameter ($d_1$) of the plurality of larger uphole openings 620. In another particular embodiment, the diameter ($d_s$) of the plurality of smaller downhole openings 610 is at least 50 percent smaller than the diameter ($d_1$) of the plurality of larger uphole openings 620. In another particular embodiment, the diameter ($d_s$) of the plurality of smaller downhole openings 610 is at least 60 percent smaller than the diameter ($d_1$) of the plurality of larger uphole openings 620, and in yet another embodiment the diameter ($d_s$) of the plurality of smaller downhole openings 610 is at least 66 percent smaller than the diameter ($d_1$) of the plurality of larger uphole openings 620.

The plurality of smaller downhole openings 610 and the plurality of larger uphole openings 620 are each linearly aligned, as discussed above with regard to FIG. 2A. In other embodiments, one or both of the plurality of smaller downhole openings 610 or the plurality of larger uphole openings 620 could be helically aligned, or aligned in another manner according to the disclosure.

Figure 6B:
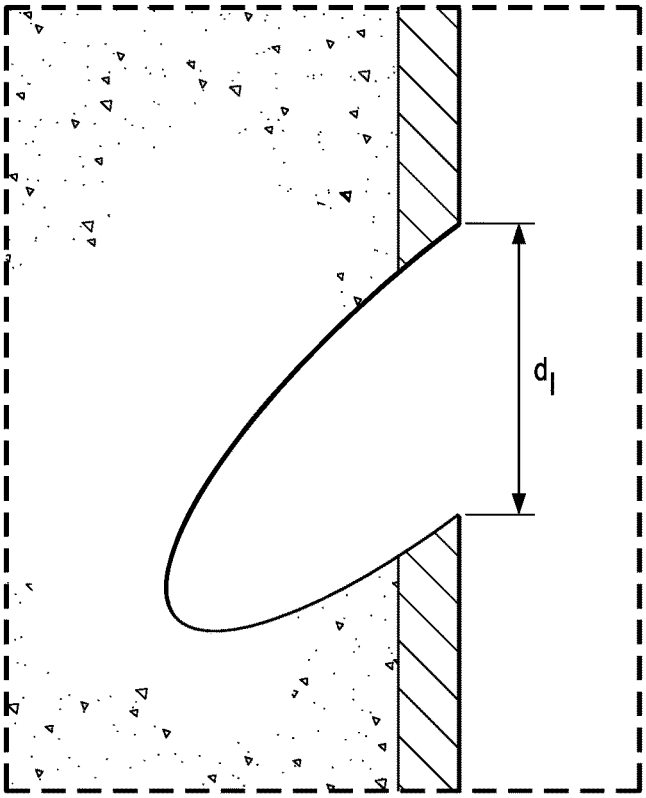
Figure 6C:
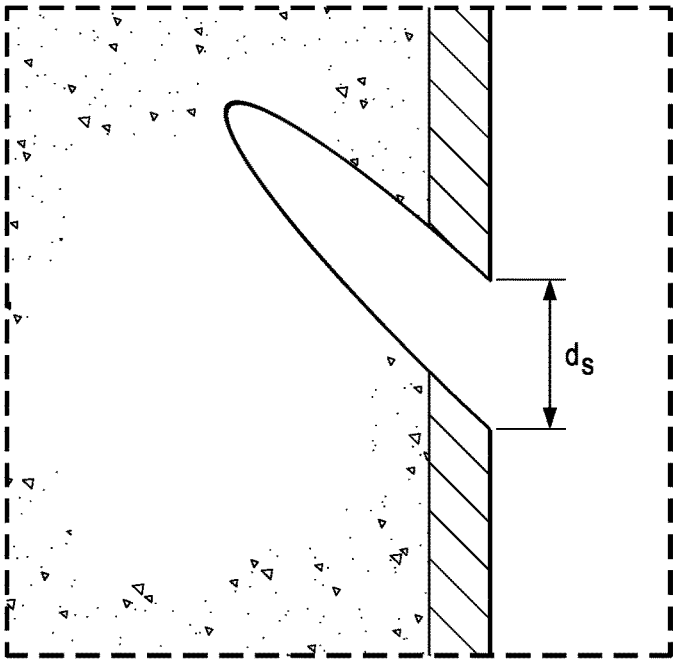

FIGS. 6B-6C additionally illustrates that one or both of the plurality of smaller downhole openings 610 or the plurality of larger uphole openings 620 may be angled relative to a longitudinal face of the wellbore casing 525. In the particular embodiment of FIGS. 6B-6C, the plurality of smaller downhole openings 610 are angled uphole relative to the longitudinal face of the wellbore casing 525, and the plurality of larger uphole openings 620 are angled downhole relative to the longitudinal face of the wellbore casing 525. Such angles are intentionally included within the wellbore casing 525, as opposed to minor non-intentional angles. Accordingly, the angles, when used, will tend to be at least 10 degrees from perpendicular to the wellbore casing surface. Other angled configurations are, however, within the scope of the disclosure.

Figure 7:
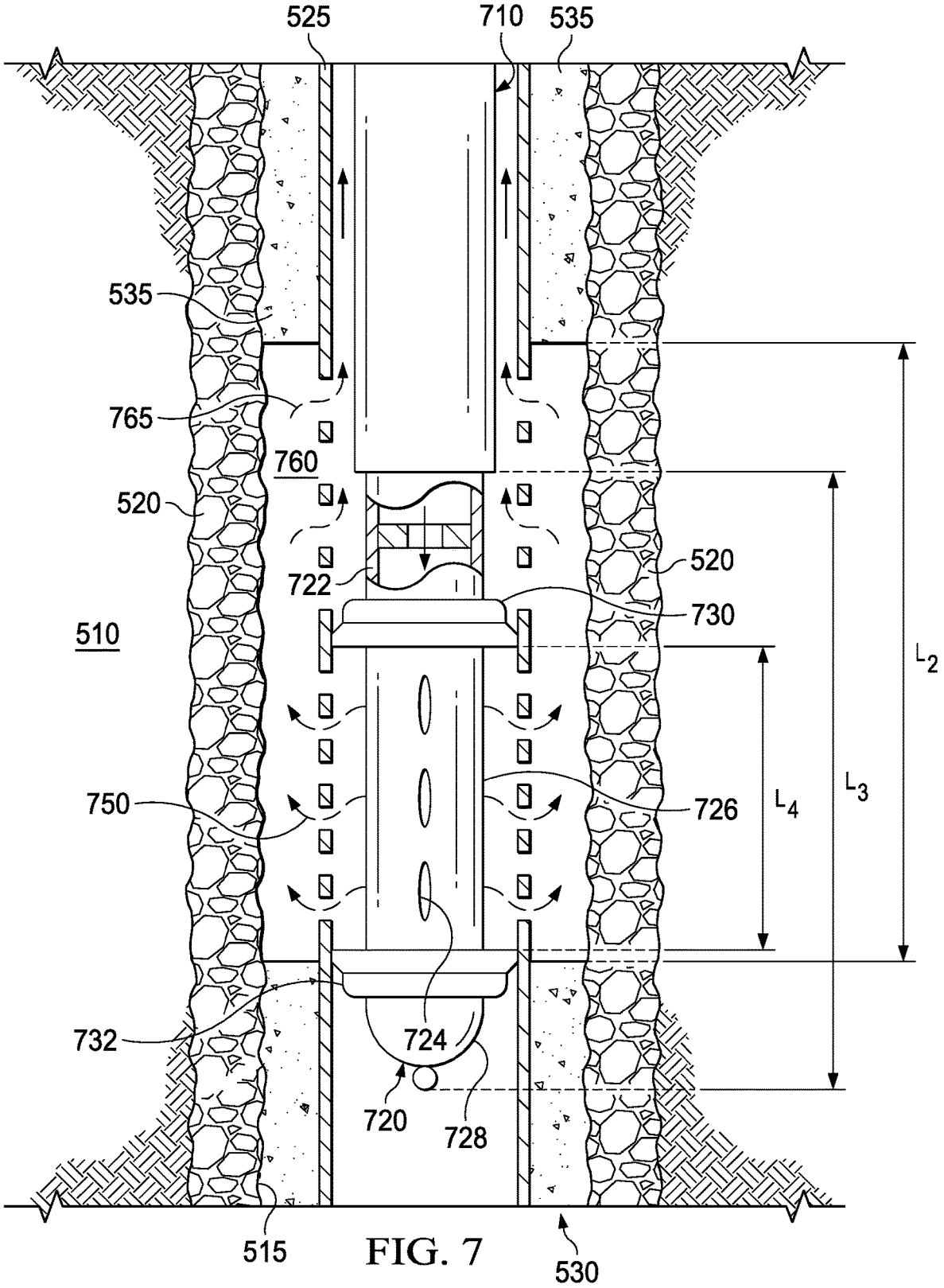

Turning to FIG. 7, illustrated is a work string 710, the lower end of which now is releasably connected to a washing tool 720 according to the disclosure. The washing tool 720, in this embodiment, has a length $L_3$. The washing tool 720 is shown disposed proximate the plurality of smaller downhole openings 610 in the wellbore casing 525, while a suitable washing fluid 750 is pumped down through the work string 710 and out into the wellbore casing 525 via the washing tool 720. Employing a directional apparatus associated with the washing tool 720, the washing fluid 750 is directed radially outward into the annulus 530 via the plurality of smaller downhole openings 610 in the wellbore casing 525.

In FIG. 7, the washing fluid 750 flows out into the annulus 530 at a lower-lying location of the longitudinal section $L_2$, after which it flows uphole through the annulus 530 and cleans an area/volume 760 of the annulus 530. By so doing, residues of cement 535, possibly also drill cuttings, deposits and/or well fluids, is/are washed away from the area/volume 760 in the annulus 530, subsequently flowing into an interior of the casing 525 via the plurality of larger uphole openings 620 in the wellbore casing 525 (e.g., at an uphole location of the longitudinal section $L_2$). Then, the washing fluid 765, including undesirable particles and possible fluids, flows uphole to the surface via the interstice located between the wellbore casing 525 and the work string 710.

In FIG. 7, the flow pattern of the washing fluid 750 is depicted with black, downstream and then upstream directed arrows. During the washing operation, the circulation pressure and circulation rate of the washing fluid 750 may also be observed, so as to be able to determine when sufficient cleaning of the annulus 530 has been achieved. Upon completion of the washing operation, the cleaned area/volume 760 may extend substantially along the entire longitudinal section $L_2$ of the well 510, as shown in FIG. 7. Moreover, during the washing operation the washing tool 720 may be moved, in a suitable manner, up and down along the longitudinal section $L_2$ in order to achieve the best possible cleaning of the annulus 530.

The washing tool 720, in one embodiment, comprises a mandrel 722 having a tubular wall provided with a number of peripherally distributed and flow-through openings 724 disposed within a discharge area 726 of the mandrel 722. This discharge area 726 has a length $L_4$. In this embodiment, a lower portion 728 of the mandrel 722 is closed to throughput.

Further, the washing tool 720 comprises a directional means which, in this embodiment, comprises a first cup-shaped packer element 730 and a second cup-shaped packer element 732, so-called swab cups, each of which extends radially outward from the mandrel 722 at a respective axial side of the discharge area 726. By so doing, the washing tool 720, when in an operational position, is structured in a manner allowing it to direct the washing fluid 750 in a radial direction between the packer elements 730, 732. These packer elements 730, 732 are radially deformable and have an outer diameter being somewhat larger than the inner diameter of the wellbore casing 525. For this reason, the packer elements 730, 732 should be pushed with force into the wellbore casing 525 for allowing them, among other things, to be deformed radially, and for overcoming friction between the packer elements 730, 732 and the wellbore casing 525 during the pushing operation.

Figure 8:
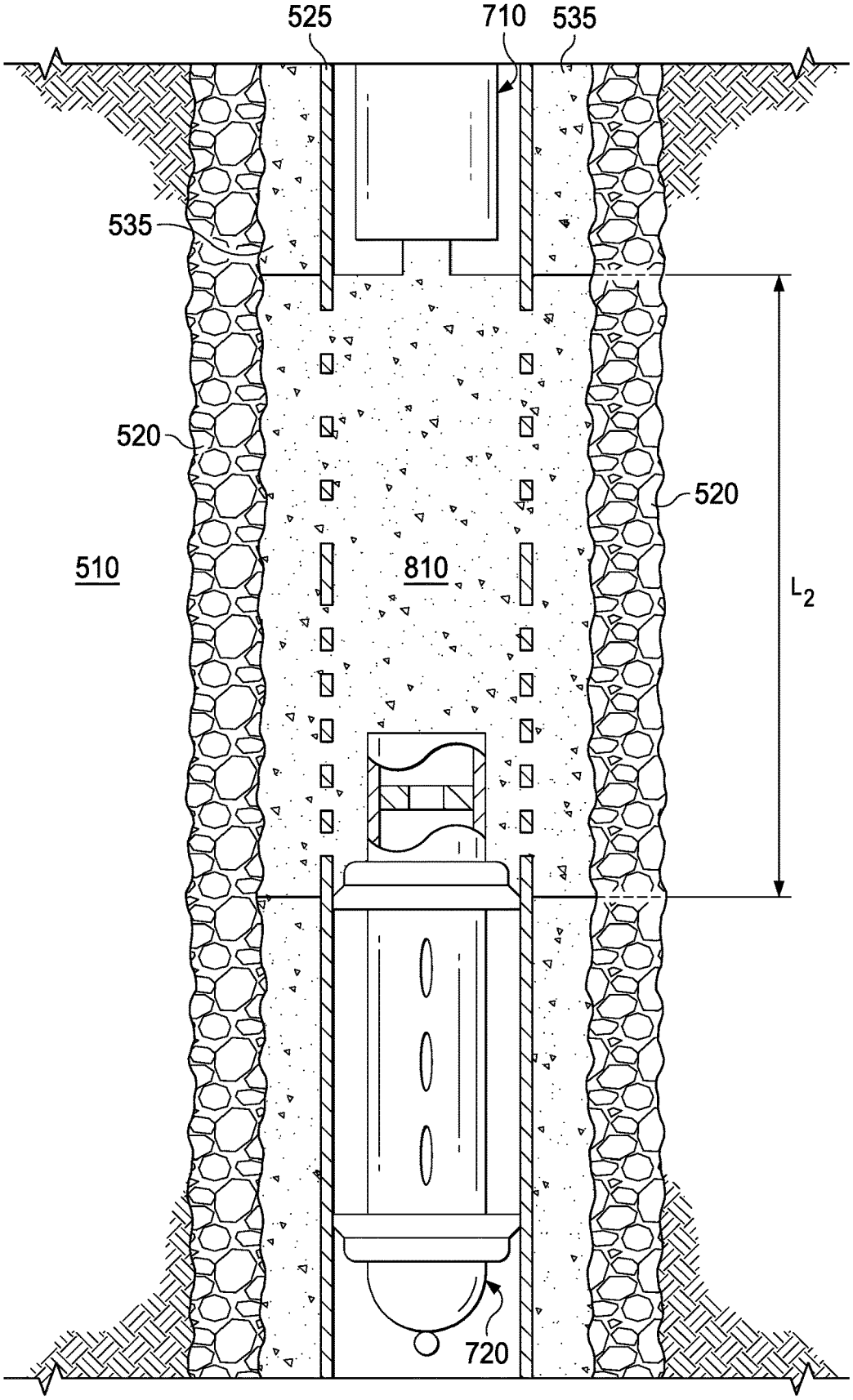

Referring now to FIG. 8, illustrated is the well 510 after the longitudinal section $L_2$ has been cleaned, and while a suitable, fluidized plugging material 810, for example cement slurry, is pumped down through the work string 710 and out into the wellbore casing 525 at the longitudinal section $L_2$. By so doing, the plugging material 810 is placed both in the wellbore casing 525 and in the annulus 530 via the plurality of smaller downhole openings 610 and/or plurality of larger uphole openings 620 in the casing 525. In this context also, the work string 710 may be moved, in a suitable manner, up and down along the longitudinal section $L_2$ in order to achieve the best possible filling of plugging material 810 in the casing 525 and in the annulus 530.

In this embodiment, and between the washing operation and the plugging operation, the work string 710 may be used to push the washing tool 720 to a location within the casing 525 underlying said longitudinal section $L_2$. At this underlying location, the washing tool 720 may then be disengaged from the work string 710, after which the washing tool 720 is left behind as a support for said plugging material 810, as shown in FIG. 8. Insofar as said packer elements 730, 732 are radially deformable and have an outer diameter being somewhat larger than the inner diameter of the wellbore casing 525, the packer elements 730, 732 will also function as a load-supporting anchoring mechanism against the wellbore casing 525 at this underlying location in the wellbore casing 525. In this manner, the washing tool 720 is converted into a support for the plugging material 810.

Figure 9:
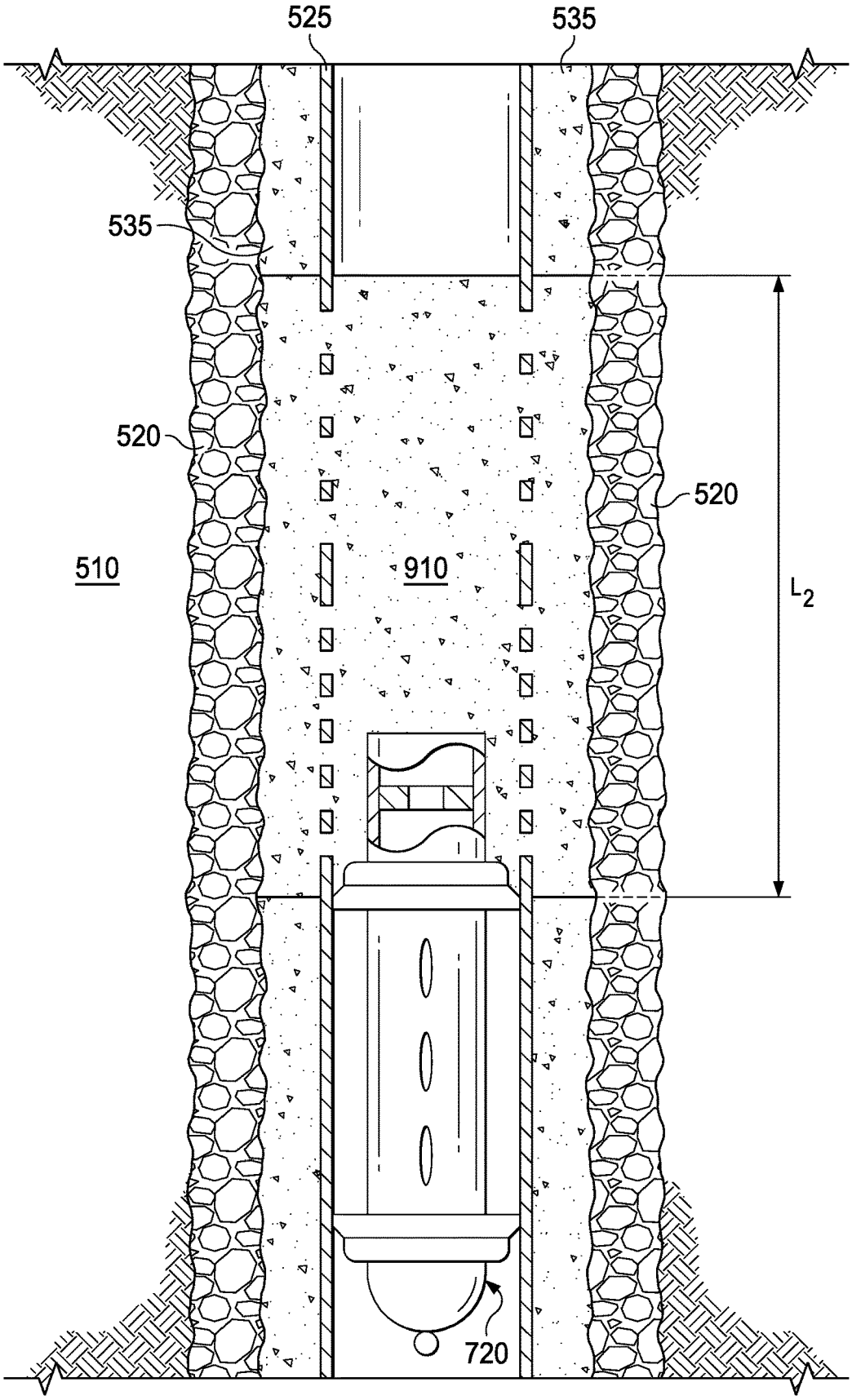

Turning finally to FIG. 9, illustrated is the well 510 having a cured cement plug 910 in the longitudinal section $L_2$, and after having pulled the work string 710 out of the well 510. The cement plug 910, in accordance with one embodiment of the disclosure, extends from an interior of the wellbore casing 525 through the plurality of smaller downhole openings 610 and the plurality of larger uphole openings 620 and into the annulus 530 between the wellbore casing 525 and the wellbore 515. Accordingly, the wellbore casing 525 and the cleaned annulus 530 are plugged along at least a portion of the longitudinal section $L_2$ of the well 510.

Aspects disclosed herein include:

A. A casing washout perforating gun assembly for use in a wellbore, the casing washout perforating gun assembly including a carrier gun body, an uphole plurality of charges supported within the carrier gun body, the uphole plurality of charges having an uphole size or uphole explosive design to perforate uphole openings having uphole opening areas within a wellbore casing, and a downhole plurality of charges supported within the carrier gun body, the downhole plurality of charges having a different downhole size or different downhole explosive design to perforate downhole openings having downhole opening areas within the wellbore casing, the downhole opening areas at least 20 percent less than the uphole opening areas.

B. A method for washing and plugging a wellbore, including 1) deploying a casing washout perforating gun assembly into a longitudinal section of a wellbore casing located within a wellbore, the casing washout perforating gun assembly including a carrier gun body, a downhole plurality of charges supported within the carrier gun body, and an uphole plurality of charges supported within the carrier gun body, 2) perforating a plurality of smaller downhole openings within the longitudinal section of the wellbore casing using the downhole plurality of charges, and a plurality of larger uphole openings within the wellbore casing using the uphole plurality of charges, the plurality of smaller downhole openings having downhole opening areas at least 20 percent less than uphole opening areas of the plurality of larger uphole openings, 3) deploying a washing tool into the wellbore casing proximate the plurality of smaller downhole openings and plurality of larger uphole openings, 4) pumping washing fluid through the washing tool radially outward into an annulus between the wellbore casing and the wellbore through the plurality of smaller downhole openings and retrieving excess washing fluid and debris from the annulus radially inward through the plurality of larger uphole openings, thereby cleaning the annulus, and 5 pumping a fluidized plugging material through a work string into the wellbore casing proximate the longitudinal section, and thereby into the cleaned annulus, using one or more of the plurality of smaller downhole openings and plurality of larger uphole openings, to plug the wellbore casing and the cleaned annulus along at least a portion of the longitudinal section of the wellbore.

C. A well system, including a wellbore casing located within a wellbore, a plurality of smaller downhole openings and a plurality of larger uphole openings located proximate one another within a longitudinal section of the wellbore casing, the plurality of smaller downhole openings having downhole opening areas at least 20 percent less than uphole opening areas of the plurality of larger uphole openings, and a cement plug located within at least a portion of the longitudinal section of the wellbore casing, the cement plug extending from an interior of the wellbore casing through the plurality of smaller downhole openings and the plurality of larger uphole openings and into an annulus between the wellbore casing and the wellbore.

Aspects A, B, and C may have one or more of the following additional elements in combination:

Element 1: wherein the downhole plurality of charges and uphole plurality of charges each include a case exterior, the case exterior including an outer surface, and an inner surface forming a cavity, a liner located within the cavity, and explosive material located within a gap between the inner surface of the case exterior and the liner. Element 2: wherein a diameter ($d_1$) of the case exterior for the downhole plurality of charges is at least 20 percent smaller than a diameter ($d_2$) of the case exterior for the uphole plurality of charges. Element 3: wherein the diameter ($d_1$) of the case exterior for the downhole plurality of charges is at least 50 percent smaller than the diameter ($d_2$) of the case exterior for the uphole plurality of charges. Element 4: wherein the downhole plurality of charges are linearly aligned within the carrier gun body. Element 5: wherein the downhole plurality of charges are helically aligned within the carrier gun body. Element 6: wherein the downhole plurality of charges are left-hand helically aligned within the carrier gun body. Element 7: wherein the uphole plurality of charges are right-hand helically aligned within the carrier gun body. Element 8: wherein the downhole plurality of charges are positioned within the carrier gun body to create angled perforations in the wellbore casing. Element 9: wherein the downhole plurality of charges are positioned within the carrier gun body to create uphole angled perforations in the wellbore casing. Element 10: wherein the uphole plurality of charges are positioned within the carrier gun body to create downhole angled perforations in the wellbore casing. Element 11: wherein a diameter ($d_s$) of the plurality of smaller downhole openings is at least 50 percent smaller than a diameter ($d_1$) of the plurality of larger uphole openings. Element 12: wherein the plurality of smaller downhole openings are linearly aligned in the wellbore casing. Element 13: wherein the plurality of smaller downhole openings are helically aligned in the wellbore casing. Element 14: wherein the plurality of smaller downhole openings are left-hand helically aligned in the wellbore casing, and the plurality of larger uphole openings are right-hand helically aligned in the wellbore casing. Element 15: wherein the plurality of smaller downhole openings are angled relative to a longitudinal face of the wellbore casing. Element 16: wherein the plurality of smaller downhole openings are angled uphole relative to a longitudinal face of the wellbore casing. Element 17: wherein the plurality of larger uphole openings are angled downhole relative to a longitudinal face of the wellbore casing.

Those skilled in the art to which this application relates will appreciate that other and further additions, deletions, substitutions and modifications may be made to the described embodiments.

What is claimed is:

1. A casing washout perforating gun assembly for use in a wellbore, the casing washout perforating gun assembly comprising:

a carrier gun body;

an uphole plurality of charges supported within the carrier gun body, the uphole plurality of charges having an uphole size or uphole explosive design to perforate uphole openings having uphole opening areas within a wellbore casing; and a downhole plurality of charges supported within the carrier gun body, the downhole plurality of charges having a different downhole size or different downhole explosive design to perforate downhole openings having downhole opening areas within the wellbore casing, the downhole opening areas at least 20 percent less than the uphole opening areas.

2. The casing washout perforating gun assembly as recited in claim 1, wherein the downhole plurality of charges and uphole plurality of charges each include:

a case exterior, the case exterior including an outer surface, and an inner surface forming a cavity;

a liner located within the cavity; and explosive material located within a gap between the inner surface of the case exterior and the liner.

3. The casing washout perforating gun assembly as recited in claim 2, wherein a diameter ($d_1$) of the case exterior for the downhole plurality of charges is at least 20 percent smaller than a diameter ($d_2$) of the case exterior for the uphole plurality of charges.

4. The casing washout perforating gun assembly as recited in claim 3, wherein the diameter ($d_1$) of the case exterior for the downhole plurality of charges is at least 50 percent smaller than the diameter ($d_2$) of the case exterior for the uphole plurality of charges.

5. The casing washout perforating gun assembly as recited in claim 1, wherein the downhole plurality of charges are linearly aligned within the carrier gun body.

6. The casing washout perforating gun assembly as recited in claim 1, wherein the downhole plurality of charges are helically aligned within the carrier gun body.

7. The casing washout perforating gun assembly as recited in claim 1, wherein the downhole plurality of charges are left-hand helically aligned within the carrier gun body.

8. The casing washout perforating gun assembly as recited in claim 7, wherein the uphole plurality of charges are right-hand helically aligned within the carrier gun body.

9. The casing washout perforating gun assembly as recited in claim 1, wherein the downhole plurality of charges are positioned within the carrier gun body to create angled perforations in the wellbore casing.

10. The casing washout perforating gun assembly as recited in claim 9, wherein the downhole plurality of charges are positioned within the carrier gun body to create uphole angled perforations in the wellbore casing.

11. The casing washout perforating gun assembly as recited in claim 10, wherein the uphole plurality of charges are positioned within the carrier gun body to create downhole angled perforations in the wellbore casing.

12. A method for washing and plugging a wellbore, comprising:

deploying a casing washout perforating gun assembly into a longitudinal section of a wellbore casing located within a wellbore, the casing washout perforating gun assembly including:

a carrier gun body;

a downhole plurality of charges supported within the carrier gun body; and an uphole plurality of charges supported within the carrier gun body;

perforating a plurality of smaller downhole openings within the longitudinal section of the wellbore casing using the downhole plurality of charges, and a plurality of larger uphole openings within the wellbore casing using the uphole plurality of charges, the plurality of smaller downhole openings having downhole opening areas at least 20 percent less than uphole opening areas of the plurality of larger uphole openings;

deploying a washing tool into the wellbore casing proximate the plurality of smaller downhole openings and plurality of larger uphole openings;

pumping washing fluid through the washing tool radially outward into an annulus between the wellbore casing and the wellbore through the plurality of smaller downhole openings and retrieving excess washing fluid and debris from the annulus radially inward through the plurality of larger uphole openings, thereby cleaning the annulus; and pumping a fluidized plugging material through a work string into the wellbore casing proximate the longitudinal section, and thereby into the cleaned annulus, using one or more of the plurality of smaller downhole openings and plurality of larger uphole openings, to plug the wellbore casing and the cleaned annulus along at least a portion of the longitudinal section of the wellbore.

13. The method as recited in claim 12, wherein a diameter ($d_s$) of the plurality of smaller downhole openings is at least 50 percent smaller than a diameter ($d_1$) of the plurality of larger uphole openings.

14. The method as recited in claim 12, wherein the plurality of smaller downhole openings are linearly aligned in the wellbore casing.

15. The method as recited in claim 12, wherein the plurality of smaller downhole openings are helically aligned in the wellbore casing.

16. The method as recited in claim 15, wherein the plurality of smaller downhole openings are left-hand helically aligned in the wellbore casing, and the plurality of larger uphole openings are right-hand helically aligned in the wellbore casing.

17. The method as recited in claim 12, wherein the plurality of smaller downhole openings are angled relative to a longitudinal face of the wellbore casing.

18. The method as recited in claim 17, wherein the plurality of smaller downhole openings are angled uphole relative to a longitudinal face of the wellbore casing.

19. The method as recited in claim 18, wherein the plurality of larger uphole openings are angled downhole relative to a longitudinal face of the wellbore casing.

* * * * *